US010194704B2

(12) United States Patent
Nygard

(10) Patent No.: US 10,194,704 B2
(45) Date of Patent: Feb. 5, 2019

(54) PANTS

(71) Applicant: NYGARD INTERNATIONAL PARTNERSHIP, Winnipeg (CA)

(72) Inventor: Peter J. Nygard, Winnipeg (CA)

(73) Assignee: NYGARD INTERNATIONAL PARTNERSHIP, Winnipeg (CA)

( * ) Notice: Subject to any disclaimer, the term of this patent is extended or adjusted under 35 U.S.C. 154(b) by 85 days.

(21) Appl. No.: 14/554,411

(22) Filed: Nov. 26, 2014

(65) Prior Publication Data

US 2015/0143855 A1 May 28, 2015

Related U.S. Application Data

(60) Provisional application No. 61/908,993, filed on Nov. 26, 2013.

(51) Int. Cl.

| | |
|---|---|
| ***A41D 1/06*** | (2006.01) |
| ***A41F 9/00*** | (2006.01) |
| ***A41F 9/02*** | (2006.01) |

(52) U.S. Cl.

CPC ..... *A41D 1/06* (2013.01); *A41F 9/00* (2013.01); *A41F 9/02* (2013.01)

(58) Field of Classification Search

CPC ..... A41D 1/06; A41F 9/00; A41F 9/02
USPC ..... 66/177; 2/79, 227, 228, 236, 237; 57/243, 244

See application file for complete search history.

(56) References Cited

U.S. PATENT DOCUMENTS 1,473,427 A * 11/1923 Handley ..... D03D 15/08 139/387 R
1,616,190 A * 2/1927 Kosofsky ..... A41F 1/00 2/228
1,880,570 A * 10/1932 Weitzenhoffer ..... A41D 1/086 2/228
2,060,467 A * 11/1936 Krein ..... A41F 9/02 2/237
2,084,938 A * 6/1937 Busch ..... A41B 11/12 112/413
2,197,188 A * 4/1940 Lilley ..... D03D 15/08 139/421
2,260,024 A * 10/1941 Smith ..... C04B 26/20 138/125
2,293,003 A * 8/1942 Hunter ..... D01H 5/36 57/2
2,416,857 A * 3/1947 Trinkel ..... A41D 10/00 2/227
2,418,187 A * 4/1947 Moore ..... D03D 15/08 139/421

(Continued)

FOREIGN PATENT DOCUMENTS

GB 1388940 A 3/1975
WO WO 2009053935 A1 * 4/2009 ..... A41D 1/06
WO WO 2010136972 A1 * 12/2010 ..... A41D 1/06

*Primary Examiner* — Khoa Huynh
*Assistant Examiner* — James Heracklis
(74) *Attorney, Agent, or Firm* — Shook, Hardy & Bacon L.L.P.

(57) ABSTRACT

A pair of pants has a main pants portion knitted from a yarn which is comprised of rayon, nylon and spandex extending from an elastic waistband fabricated of polyester and rubber. The main pants portion of the pants can be sized so that said fabric is in a stretched condition about the buttocks and thighs of a wearer.

12 Claims, 7 Drawing Sheets

(56) References Cited

U.S. PATENT DOCUMENTS 2,630,575 A * 3/1953 Feinberg ..... A41F 9/00 2/236
2,640,508 A * 6/1953 Siciliano ..... D03D 15/08 139/419
2,890,567 A * 6/1959 Taylor ..... B60C 9/0042 28/240
3,098,347 A * 7/1963 Smith ..... D02G 3/322 57/18
3,301,018 A * 1/1967 Knohl ..... D02G 3/322 57/225
3,775,960 A * 12/1973 Ogawa ..... D02G 3/46 112/413
3,788,365 A * 1/1974 Campbell, Sr. ..... A41F 9/02 139/421
3,788,366 A * 1/1974 Campbell, Sr. ..... A41F 9/02 139/419
3,805,299 A * 4/1974 Saad-Chujfi ..... A41F 9/02 2/237
3,842,437 A * 10/1974 Campbell ..... A41F 9/02 2/237
3,842,438 A * 10/1974 Campbell, Sr. ..... A41F 9/02 116/217
3,858,622 A * 1/1975 Campbell ..... D03D 15/08 139/421
3,882,667 A * 5/1975 Barry ..... D02G 3/12 28/281
3,886,598 A * 6/1975 Campbell ..... A41F 9/02 2/237
3,920,054 A * 11/1975 Goff, Jr. ..... D03D 15/08 139/386
3,930,090 A * 12/1975 Campbell, Sr. ..... A41F 9/00 2/221
3,965,943 A * 6/1976 Goff, Jr. ..... A41F 9/02 139/421
3,965,944 A * 6/1976 Goff, Jr. ..... D03D 15/08 139/419
3,978,259 A * 8/1976 Hilton ..... D06M 15/643 2/221
4,236,550 A * 12/1980 Braun ..... D03D 15/08 602/76
4,248,036 A * 2/1981 Barron ..... D02G 1/16 28/271
4,424,808 A * 1/1984 Schafer ..... A61F 13/0273 139/421
4,470,156 A * 9/1984 Duerbeck ..... A41D 1/08 2/227
4,477,928 A * 10/1984 Graff ..... A41F 9/025 2/221
4,625,336 A * 12/1986 Derderian ..... A41D 13/0015 2/227
4,838,017 A * 6/1989 Kolmes ..... D02G 3/12 2/167
4,912,781 A * 4/1990 Robins ..... A41D 19/01511 2/16
4,980,930 A * 1/1991 Cusimano ..... A41F 9/00 2/220
5,016,291 A * 5/1991 Capper ..... A41F 9/002 2/221
5,040,244 A * 8/1991 Tubbs ..... A41F 9/025 2/221
5,210,877 A * 5/1993 Newman ..... A41D 1/067 2/115
5,241,707 A * 9/1993 Kato ..... A41D 1/06 112/475.13
5,375,266 A * 12/1994 Crisco ..... A41F 9/025 2/221
5,424,123 A * 6/1995 Geirhos ..... D02G 1/165 428/357
5,568,719 A * 10/1996 Proctor ..... D02G 3/367 57/12
5,619,848 A * 4/1997 Costales ..... D01H 11/00 57/12
5,787,510 A * 8/1998 Jackson, Jr. ..... D04B 21/18 139/422
5,963,988 A * 10/1999 Jackson, Jr. ..... A41F 9/025 139/422
6,240,716 B1 * 6/2001 Yanagawase ..... D02G 3/328 428/370
6,311,333 B1 * 11/2001 Batra ..... A41D 1/06 2/221
6,410,140 B1 * 6/2002 Land ..... D02G 3/185 428/370
6,581,366 B1 * 6/2003 Andrews ..... D02G 3/328 57/225
7,260,961 B1 * 8/2007 Kennedy ..... D04B 1/243 66/171
7,526,929 B2 * 5/2009 Takamoto ..... A41B 11/14 66/177
7,533,423 B2 * 5/2009 Rudolph ..... A41D 1/086 2/227
7,549,281 B2 * 6/2009 Kuwano ..... D01F 2/06 57/243
D662,281 S * 6/2012 Iamartino ..... D2/742
D668,434 S * 10/2012 Iamartino ..... D2/742
D673,756 S * 1/2013 Agnew ..... D2/742
D679,483 S 4/2013 Fuerst
D679,890 S 4/2013 Persaud
D688,032 S * 8/2013 Harte ..... D2/742
9,719,196 B2 * 8/2017 Salama ..... D03D 1/0052
2003/0101506 A1 * 6/2003 Fujii ..... A41D 1/08 2/240
2003/0121245 A1 * 7/2003 Niwa ..... D02G 3/322 57/244
2004/0255358 A1 * 12/2004 Ota ..... A41D 13/0015 2/69
2006/0130215 A1 * 6/2006 Torry ..... A41D 1/08 2/227
2006/0169004 A1 * 8/2006 Belluye ..... A41D 1/084 66/177
2006/0179810 A1 * 8/2006 Liao ..... D01F 8/14 57/200
2006/0230503 A1 * 10/2006 Shterenberg ..... A41D 1/06 2/309
2007/0033696 A1 * 2/2007 Sellier ..... A41D 13/0017 2/69
2008/0034476 A1 * 2/2008 MacKinnon ..... A41B 11/003 2/228
2008/0120757 A1 * 5/2008 Nakazawa ..... A41D 13/0015 2/22
2008/0201830 A1 * 8/2008 Ishida ..... A41C 1/003 2/467
2008/0250551 A1 * 10/2008 Mazzarolo ..... A41D 13/02 2/456
2009/0007311 A1 * 1/2009 Semba ..... A41D 1/08 2/69
2009/0172859 A1 * 7/2009 Clement ..... A41D 1/08 2/69
2009/0254017 A1 * 10/2009 Dumpson ..... A41C 1/02 602/67
2009/0293167 A1 * 12/2009 Kottler ..... A41D 1/08 2/23
2010/0024089 A1 * 2/2010 Turner ..... A41D 13/05 2/23
2010/0130903 A1 * 5/2010 Rock ..... A61F 13/06 602/62
2011/0214216 A1 * 9/2011 Zarabi ..... A41D 27/02 2/69
2011/0219510 A1 * 9/2011 Nuzzo ..... A41D 13/0575 2/16
2012/0204605 A1 * 8/2012 Conti ..... D04B 1/243 66/177
2013/0095730 A1 * 4/2013 Jensen ..... A41C 1/003 450/95
2013/0101781 A1 * 4/2013 Lee ..... D02G 3/36 428/91
2013/0260628 A1 * 10/2013 Woods, II ..... D03D 15/08 442/184

(56) References Cited

U.S. PATENT DOCUMENTS

| | | | | |
|---|---|---|---|---|
| 2013/0305425 | A1* | 11/2013 | Zarabi | A41D 1/06 2/69 |
| 2013/0312157 | A1* | 11/2013 | Freddi | A41D 1/06 2/227 |
| 2014/0000005 | A1* | 1/2014 | Berns | A41D 13/1263 2/79 |
| 2014/0020155 | A1* | 1/2014 | Israel | A41D 1/06 2/237 |
| 2014/0165265 | A1* | 6/2014 | Tulin | A41D 1/06 2/234 |
| 2014/0259291 | A1* | 9/2014 | Wior | A41D 1/06 2/227 |
| 2015/0107000 | A1* | 4/2015 | Tanaka | A41D 1/08 2/227 |
| 2015/0143855 | A1* | 5/2015 | Nygard | A41D 1/06 66/177 |
| 2015/0342270 | A1* | 12/2015 | Harris | A41D 1/06 2/227 |
| 2016/0081402 | A1* | 3/2016 | Nixon, Jr. | A41D 1/08 2/227 |

* cited by examiner

PANTS

CROSS-REFERENCE TO RELATED APPLICATIONS

This application claims the benefit of U.S. Provisional Patent Application No. 61/908,993, filed Nov. 26, 2013, entitled "Pants," which is incorporated by reference herein.

BACKGROUND OF THE INVENTION

The present invention relates to pants (trousers).

A wide variety of pants are known, however, a need remains for an improved pants design.

BRIEF SUMMARY OF THE INVENTION

A pair of pants has a main pants portion fabricated of a fabric which is rayon, nylon and spandex extending from an elastic waistband that may be fabricated of polyester and rubber. The main pants portion of the pants can be sized so that said fabric is in a stretched condition about the buttocks and thighs of a wearer.

In an aspect, there is provided a pair of pants comprising: an elastic waistband comprising an elastic material of polyester and rubber; a main pants portion extending from said waistband; said main pants portion knitted from a yarn comprising rayon, nylon and spandex.

In another aspect, there is provided a pair of pants comprising an elastic waistband; a main pants portion extending from said waistband; said main pants portion knitted from a yarn which is about 70% rayon, about 27% nylon and about 3% spandex.

Other features and advantages will become apparent by reference to the following description in conjunction with the drawings.

DETAILED DESCRIPTION OF THE INVENTION

Figure 1:
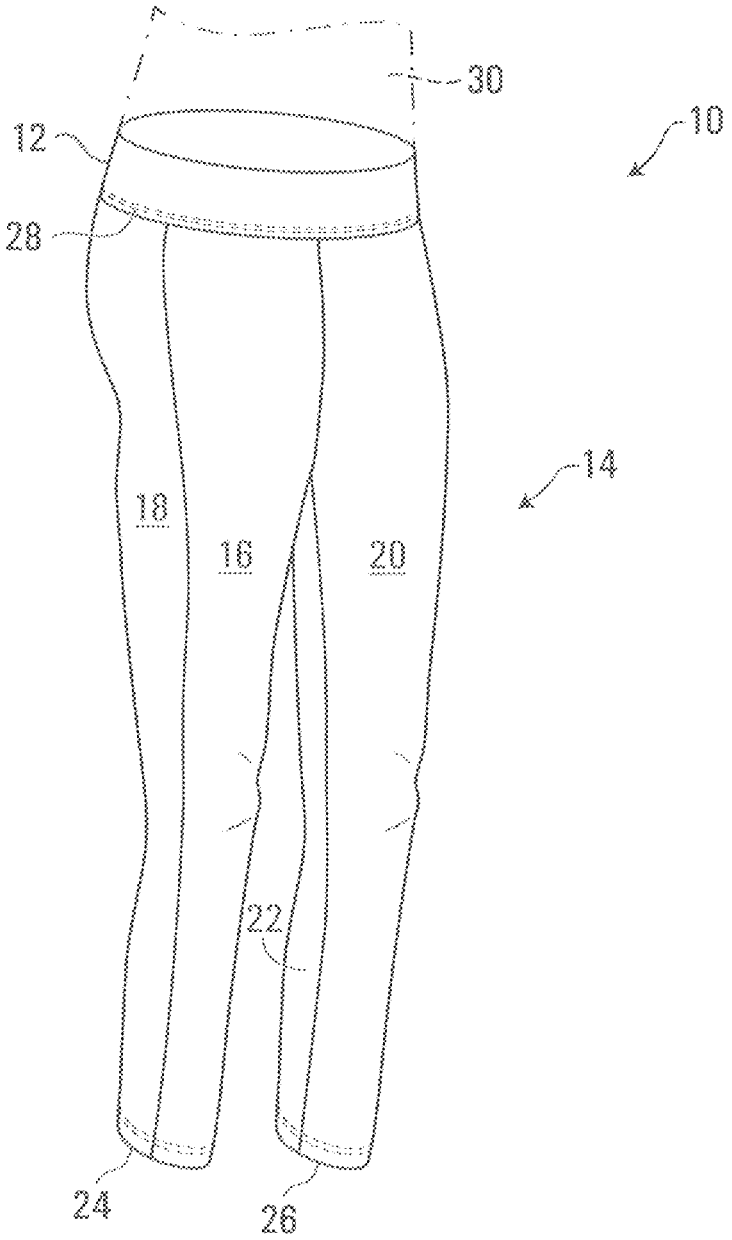
FIG. 1 is a front perspective view of pants made in accordance with an embodiment.
Figure 2:
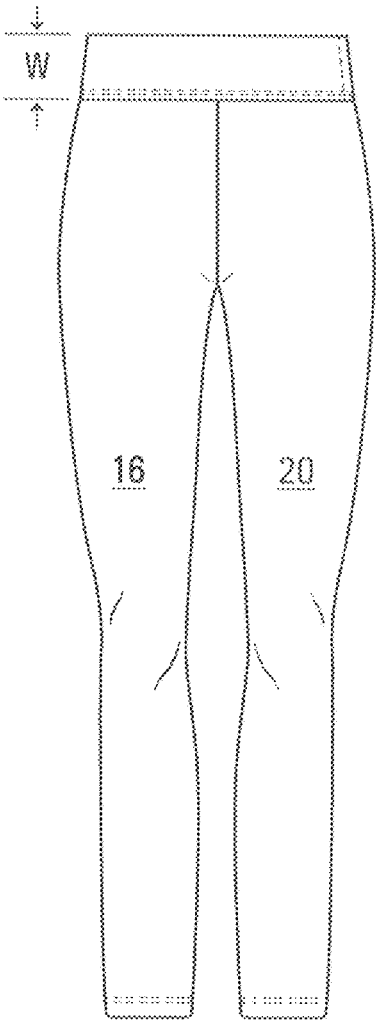
FIG. 2 is a front view of the pants of FIG. 1.
Figure 3:
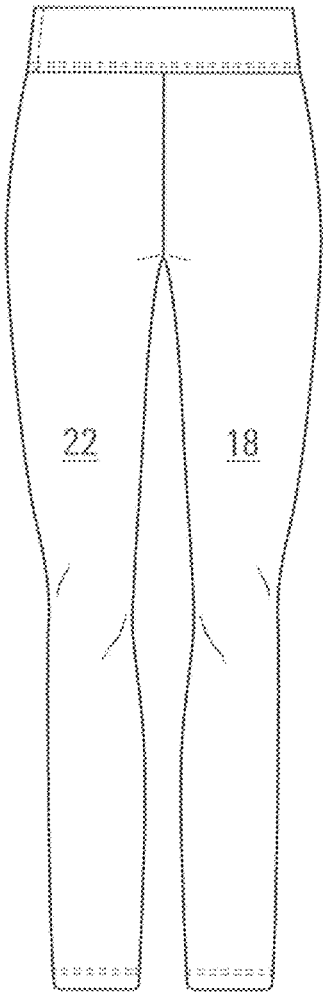
FIG. 3 is a rear view of the pants of FIG. 1.

Turning to FIGS. 1 to 5, a pair of pants 10 has a waistband 12 and a main pants portion 14. The main pants portion has left side front panel 16 and rear panel 18 and a right side front panel 20 and rear panel 22. When the pants are worn, front panel 16 covers the left thigh and front of the left leg of the wearer 30, back panel 18 covers the left buttock and rear of the left leg of the wearer, front panel 20 covers the right thigh and front of the right leg of the wearer, and back panel 22 covers the right buttock and rear of the right leg of the user. Each leg terminates in a cuff 24, 26. A bottom margin of the waistband 12 is stitched to a top margin of the main pants portion 14 along stitch line 28 so that the waistband extends above the main pants portion.

Each panel 16, 18, 20, 22 may be knitted from a yarn which is about 70% rayon, about 27% nylon and about 3% spandex. The knitting process may be selected to provide about a 24 gauge fabric.

Figure 6:
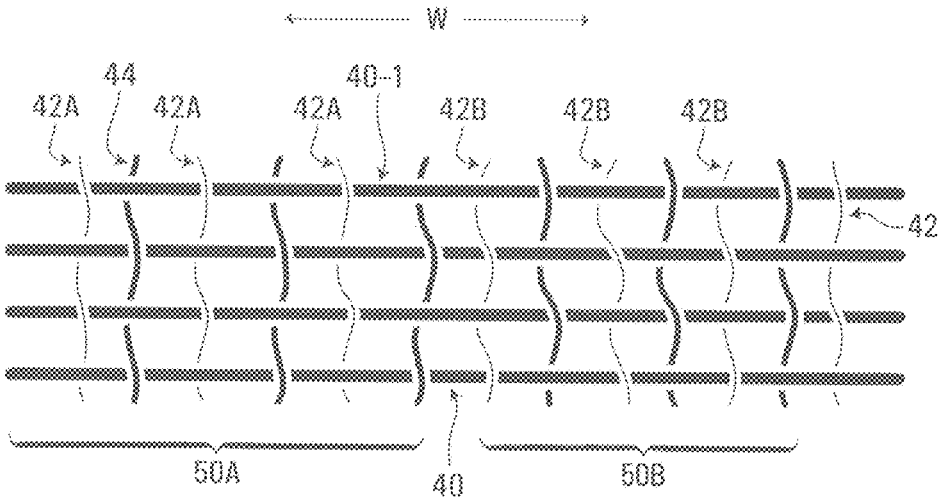
FIG. 6 is a schematic view illustrating the weave of the waistband of the pants of FIG. 1, FIG. 7A are patterns for the front of a leg and buttock portion of the pants of FIG. 1, FIG. 7B are patterns for the back of a leg and buttock portion of the pants of FIG. 1.

The waistband may have a uniform width, W, of at least about 3.5" (9 cm). The waistband may be woven. More specifically, turning to FIG. 6, the waistband may be woven such that the weft extends in a transverse direction along the waistband (i.e., parallel to the width dimension, W, of the waistband). The weft may be composed of yarn threads 40 and the warp of the waistband may be composed of alternating elastic threads 42 and yarn threads 44. The alternating elastic threads and yarn threads may be further arranged in alternating first and second patterns of threads. Thus, a first pattern 50A of three elastic threads 42 alternating with three yarn threads 44 is woven adjacent a second pattern 50B of three elastic threads 42 alternating with three yarn threads 44. In each first pattern 50A, each elastic thread 42A loops over a weft thread 40-1, whereas in each second pattern 50B, each elastic thread 42B loops under weft thread 40-1. The alternating first and second patterns 50A, 50B provide a textured look to the waistband. In modified embodiments, there may be a different number of threads in each pattern, such as two elastic threads and two yarn threads in each pattern. The elastic threads may be fabricated of about 65% polyester and about 35% rubber. With this construction, the waistband has elasticity in its longitudinal direction. The waistband may be coverstitched to the main pants portion 14 (FIG. 1) to provide a measure of elasticity in the joint between the waistband and main pants portion so as not to impede the longitudinal elasticity of the waistband.

Figure 4:
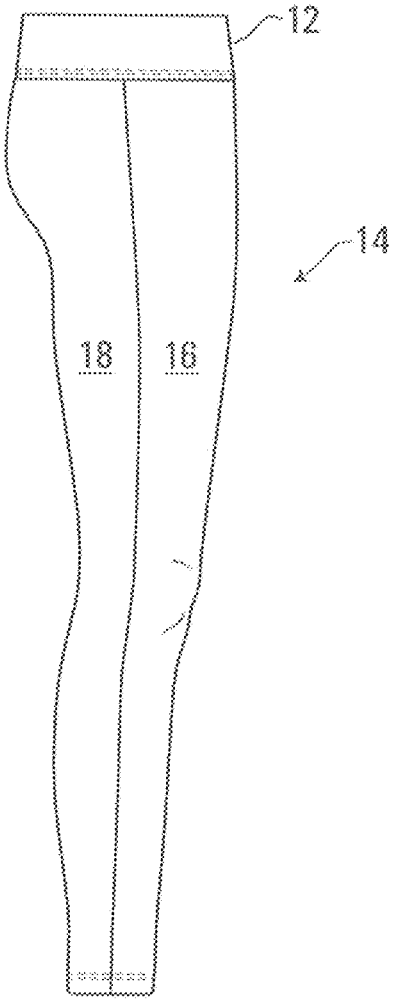
FIG. 4 is a left side view of the pants of FIG. 1.
Figure 5:
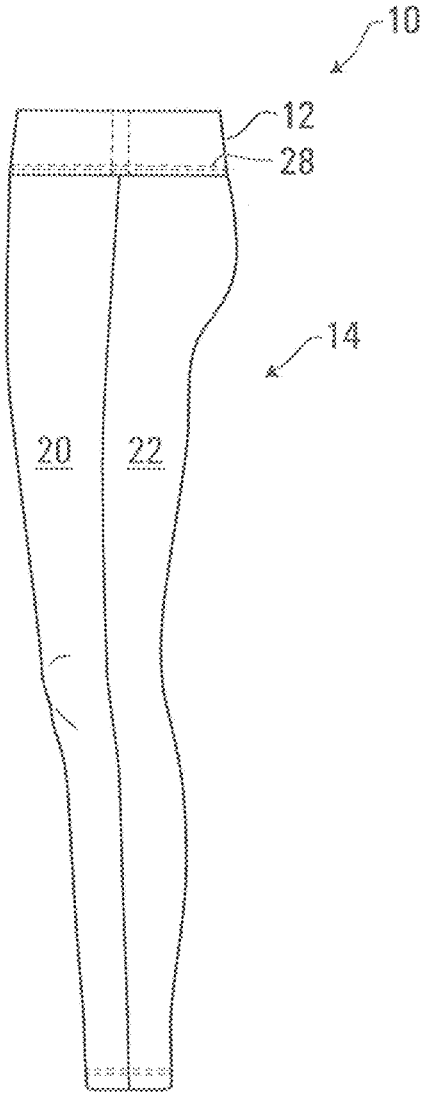
FIG. 5 is a right side view of the pants of FIG. 1.
Figure 7A:
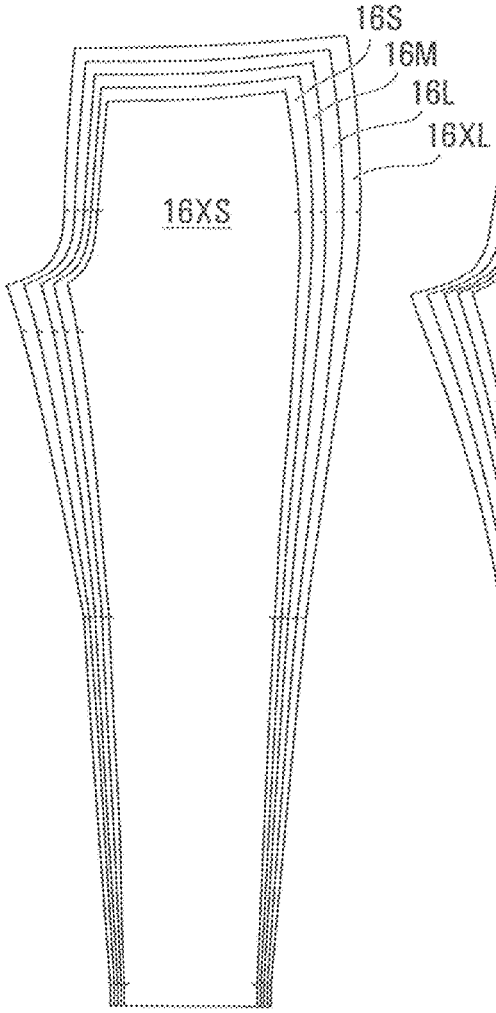
FIG. 7C is a pattern of the waistband of the pants of FIG. 1.
Figure 7B:
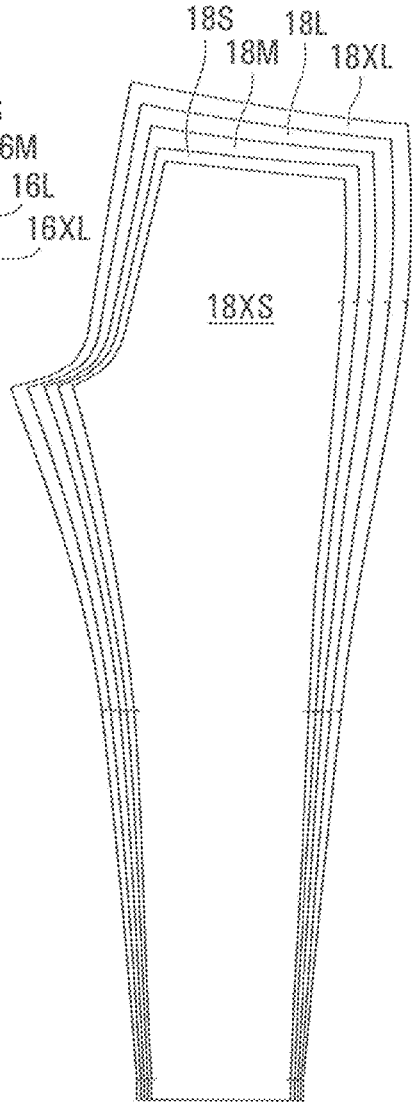
Figure 7C:
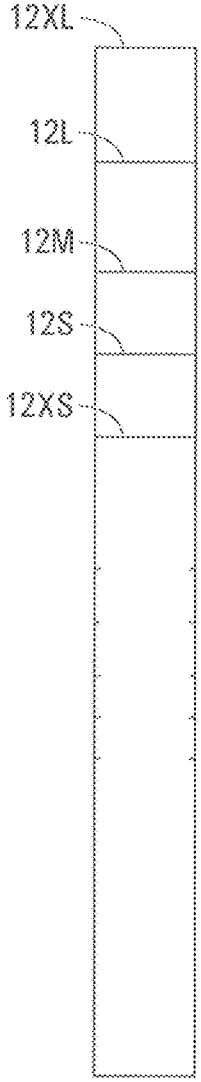

Turning to FIG. 7A along with FIGS. 4 and 5, left front panel 16 may be patterned from extra small pattern 16XS, small pattern 16S, medium pattern 16M, large pattern 16L, and extra-large pattern 16XL. Referencing FIG. 7B, left rear panel 18 may be correspondingly patterned from extra small pattern 18XS, small pattern 18S, medium pattern 18M, large pattern 18L, and extra-large pattern 18XL. These patterns may also be used to make the right front panel 20 and rear panel 22 of the main portion of the pants. Referencing FIG. 7C, a correspondingly sized waistband 12 may be patterned from extra small pattern 12XS, small pattern 12S, medium pattern 12M, large pattern 12L, and extra-large pattern 12XL.

The patterns for the main portion 14 of the pants 10 are sized so that said fabric of the panels patterned therefrom will be perpetually in a stretched condition about the buttocks, thighs, and legs of the wearer 30. Similarly, the patterns for the waistband are sized so that the waistband will be perpetually in a stretched condition about the waist of the wearer.

The perpetual compressive force of the waistband applied over the wide width of the waistband has a slimming effect on the wearer and also provides a perpetual uplifting force on the pants so that they do not slide down in use, such as when the wearer bends over.

With the fabric of the panels of the main portion of the pants knitted from a yarn having about 70% rayon, about 27% nylon and about 3% spandex, the main portion of the pants stretch from a relaxed condition when worn to provide a compressive, slimming, force about the buttocks, thighs and legs of the user. Moreover, the elasticity of the panels is such that if a wearer bends over, the main portion of the pants do not ride up on the legs or into the crotch or intergluttal cleft of the wearer. Furthermore, when the pants are removed, the main portion of the pants will recover to their original relaxed condition, despite the fact that the panels of the main portion of the pants are knitted.

Figure 8:
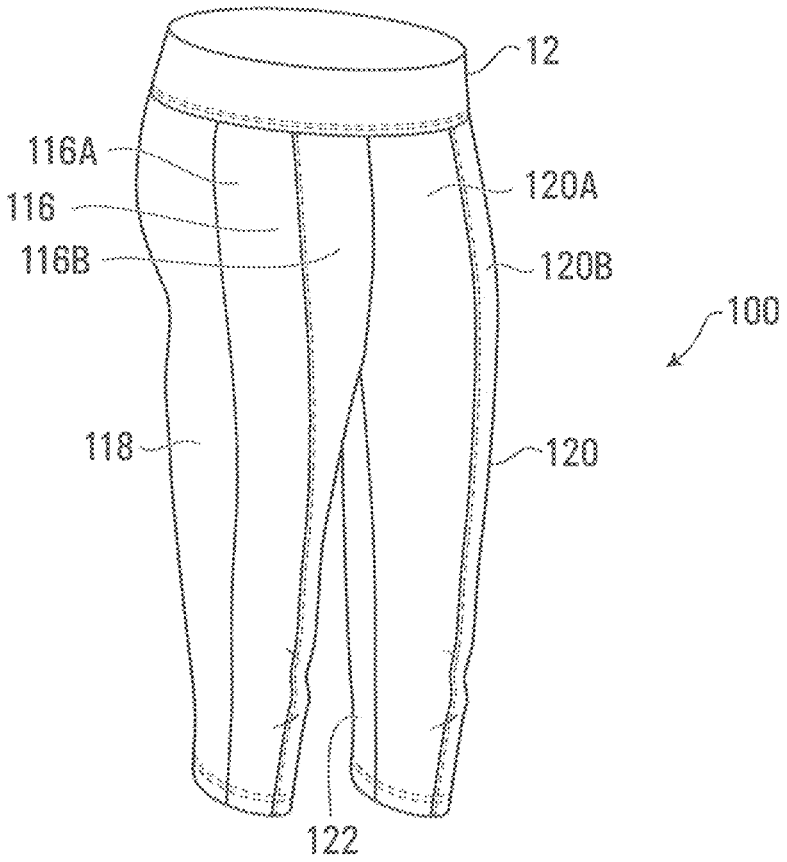
FIG. 8 is a front perspective view of pants made in accordance with a second embodiment, FIG. 9A are patterns for the front of a leg and buttock portion of the pants of FIG. 8, FIG. 9B are patterns for the back of a leg and buttock portion of the pants of FIG. 8.

FIG. 8 shows a second embodiment of pants. Turning to FIG. 8, pants 100 are similar to pants 10—and like reference numerals have been given to like parts—except that pants 100 are culottes such that the legs of the pants end just below the knee of a wearer. Further, the front panels of the main portions of the pants are stitched together from two panel halves. Thus, left front panel 116 has panel halves 116A, 116B and right front panel 120 has panel halves 120A, 120B.

Figures 9A, 9B, 9C:
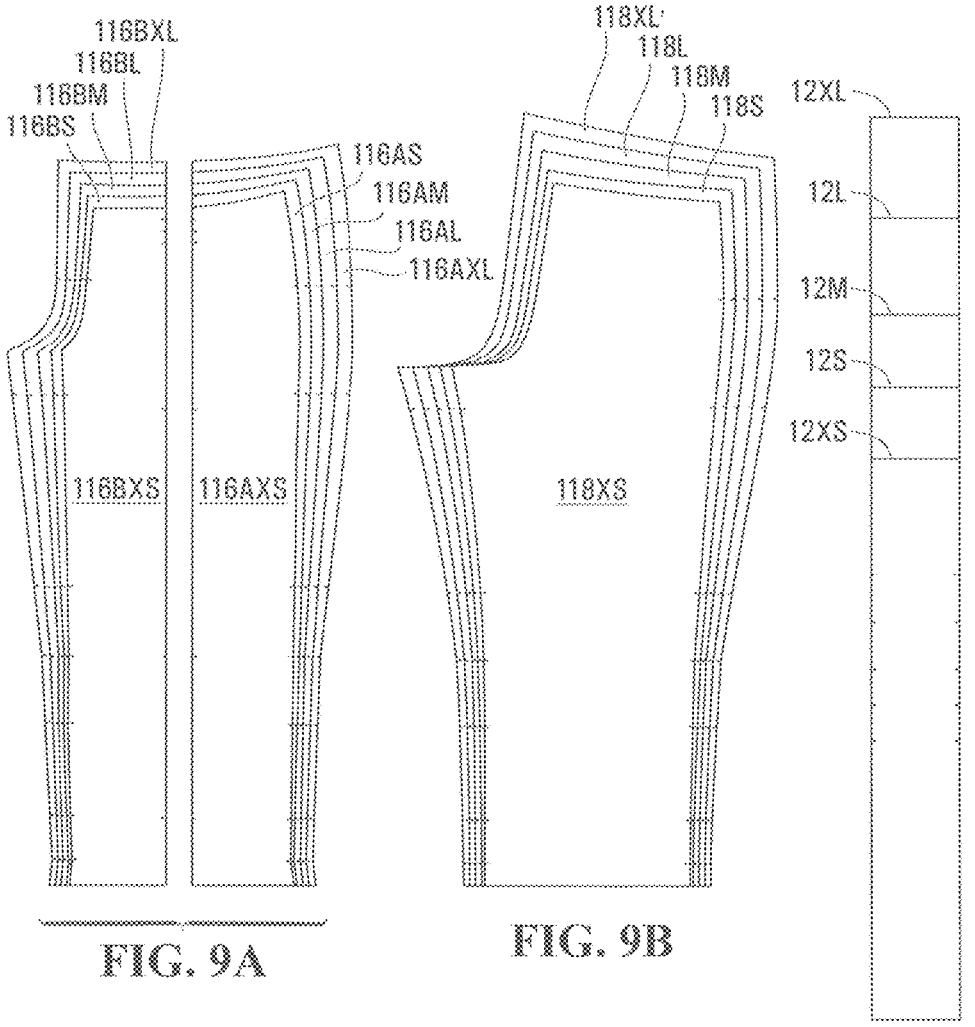
FIG. 9C is a pattern of the waistband of the pants of FIG. 8.

Turning to FIG. 9A along with FIG. 8, left front panel half 116A may be patterned from extra small pattern 116AXS, small pattern 116AS, medium pattern 116AM, large pattern 116AL, and extra-large pattern 116AXL. Left front panel half 116B may be correspondingly patterned from extra small pattern 116BXS, small pattern 116BS, medium pattern 116BM, large pattern 116BL, and extra-large pattern 116BXL. Referencing FIG. 9B, left rear panel 118 may be correspondingly patterned from extra small pattern 118XS, small pattern 118S, medium pattern 118M, large pattern 118L, and extra-large pattern 118XL. Referencing FIG. 9C, the pattern for the waistband 12 may be correspondingly chosen from extra small pattern 12XS, small pattern 12S, medium pattern 12M, large pattern 12L, and extra-large pattern 12XL.

Pants 100 are made of identical materials to the pants 10 of FIGS. 1 to 6. Thus, similarly to pants 10 of FIGS. 1 to 6, pants 100 of FIG. 8, when worn, stretch over the buttocks and thighs of a user and the waistband is perpetually in compression such that the pants have a slimming effect on the wearer. Further, the pants stay in place during use, such as when the user bends over or sits down.

Other modifications will be apparent to those skilled in the art and, therefore, the invention is defined in the claims.

The invention claimed is:

1. A pair of pants comprising:

an elastic waistband comprising an elastic material of polyester and rubber;

a main pants portion extending from said elastic waistband;

said main pants portion being fabricated from a fabric, said fabric knitted from a yarn comprising rayon, nylon and spandex, wherein said elastic material of said elastic waistband is elastic threads;

wherein said elastic waistband is woven with a weft of first yarn threads, said first yarn threads extending in a transverse direction along said elastic waistband and a warp of alternating ones of said elastic threads and second yarn threads, said elastic threads and said second yarn threads extending in a longitudinal direction along said elastic waistband; and wherein said elastic threads and said second yarn threads are arranged into a repeated first group of threads alternating with a repeated second group of threads on a given one of said first yarn threads such that any given first group of threads has an adjacent second group of threads and said second yarn threads arranged into said second pattern, and wherein all threads of each said first group of threads lie side-by-side without any intervening threads of any said second group of threads, each said first group of threads having at least two of said elastic threads and a same number of said second yarn threads and each said second group of threads having at least two of said elastic threads and a same number of said second yarn threads, and wherein said elastic threads in each said first group of threads loop over said given one of said first yarn threads and said elastic threads in each said second group of threads loop under said given one of said first yarn threads.

2. The pants of claim 1 wherein said elastic waistband extends above said main pants portion and wherein a bottom margin of said elastic waistband is joined to said main pants portion.

3. The pants of claim 2 wherein said bottom margin of said elastic waistband is coverstitched to said main pants portion.

4. The pants of claim 3 wherein said elastic waistband has a minimum width of at least about 3.5" (9 cm).

5. The pants of claim 1 wherein said elastic material of said elastic waistband has a uniform width of at least about 3.5" (9 cm).

6. The pants of claim 4 wherein said main pants portion is sized so that said fabric is perpetually in a stretched condition about the buttocks and thighs of a wearer.

7. The pants of claim 6 wherein said fabric is about a 24 gauge fabric.

8. The pants of claim 7 wherein said elastic waistband is sized so that it is perpetually in a stretched condition about the waist of said wearer.

9. The pants of claim 1 wherein said yarn comprises about 70% rayon, about 27% nylon and about 3% spandex.

10. The pants of claim 1 wherein said elastic waistband comprises about 65% polyester and about 35% rubber.

11. The pants of claim 8 wherein said elastic waistband comprises about 65% polyester and about 35% rubber.

12. The pants of claim 1 wherein there are no intervening threads between said given first group of threads and said adjacent second group of threads.

* * * * *